United States Patent [19]

Worthington

[11] Patent Number: 4,522,130

[45] Date of Patent: Jun. 11, 1985

[54] COLLAPSIBLE TEA CART

[76] Inventor: Roy Worthington, 327 Harbin, Waxahachie, Tex. 75165

[21] Appl. No.: 481,360

[22] Filed: Apr. 1, 1983

[51] Int. Cl.[3] ..... A47B 3/06

[52] U.S. Cl. ..... 108/159; 248/167

[58] Field of Search ..... 108/157, 158, 159, 79; 248/167

[56] References Cited

U.S. PATENT DOCUMENTS

| | | | |
|---|---|---|---|
| 1,963,594 | 6/1934 | Schwabe | 108/159 |
| 3,188,158 | 6/1965 | Sanchez | 108/79 X |
| 3,912,210 | 10/1975 | von Bohr | 108/159 X |

*Primary Examiner*—Kenneth Downey

*Attorney, Agent, or Firm*—H. Mathews Garland

[57] ABSTRACT

A portable mobile foldable table including a foldable frame having rigidly connected upper and lower side rails and legs, inwardly foldable end rail assemblies, and upper and lower trays which fit within the framework of the upper and lower side and end rail assemblies rigidly locking the frame in operating position. Shoulder surfaces along the side rails with an engageable relationship between the top edges of the end rail assemblies with end handles on the trays provides support at tray ends as well as support along the full lengths of the opposite sides of the trays. The spacing between the legs, side rails, and folded end rail assemblies provides storage space within the folded frame for two trays which are slightly longer than the distance between the legs at opposite ends of the frame assembly so that the trays rest on the folded lower end rail assemblies contained between the legs on opposite sides of the frame for tray storage when the frame is fully folded.

12 Claims, 8 Drawing Figures

COLLAPSIBLE TEA CART

This invention relates to portable mobile tables and more particularly to a collapsible tea cart.

Collapsible serving tables such as tea carts have been known in the past, for example, as shown in U.S. Pat. No. 1,963,594 issued June 19, 1934 and U.S. Pat. No. 2,089,436 issued Aug. 10, 1937 to E. J. Schwabe. Both patents illustrate folding serving tables having removable trays. Such prior art tables and other known similar tables do not provide support along each of the four sides of the removable trays. Also, the frames of such tables do not provide a satisfactory, stable, storage space for the trays when folded.

It is a principal object of the present invention to provide a new and improved collapsible table or tea cart.

It is another object of the invention to provide a tea cart having a foldable frame designed to provide storage space within the frame for the removable trays.

It is another object of the invention to provide a collapsible tea cart having support surfaces for each of the four sides of each of the removable trays.

It is another object of the invention to provide a collapsible tea cart wherein the collapsible frame of the cart which is locked in open position by the removable trays.

In accordance with the invention there is provided a collapsible tea cart having a foldable frame provided with upper and lower side rails each having upwardly and inwardly opening internal grooves defining seating shoulders for supporting the sides of the upper and lower trays and foldable end rails engageable by end handles on the trays for added support of the tray ends. The trays when installed lock the hinged end rails against folding. When the frame is folded the frame legs are held in spaced parallel relationship providing storage space for the two removable trays which rest on the folded lower end rails between the legs and the lower side rails.

The foregoing objects and advantages of the invention and the specific details of a preferred embodiment thereof will be better understood from the following detailed description taken in conjunction with the accompanying drawings wherein.

Figure 1:
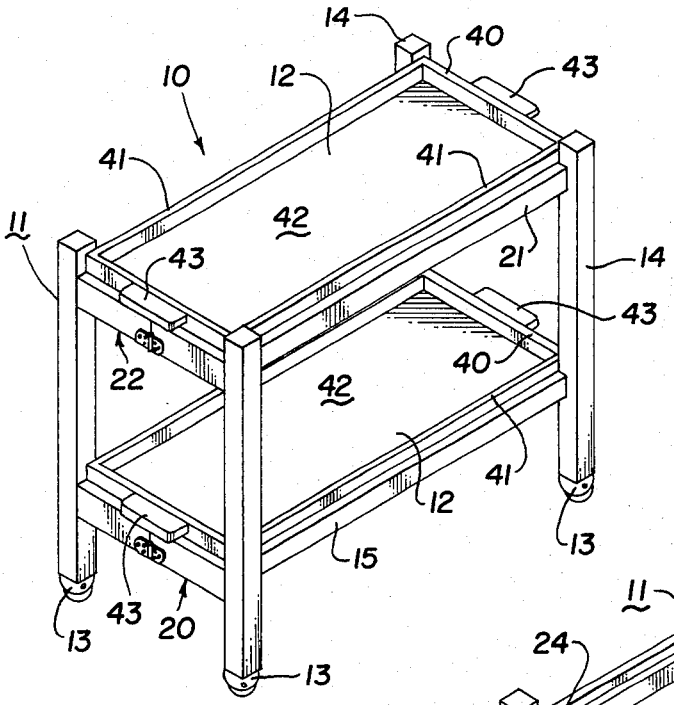
FIG. 1 is a perspective view of a collapsible tea cart in accordance with the invention in open operating condition with both trays installed.

Referring to the drawings, a collapsible tea cart 10 embodying the features of the invention includes a collapsible frame 11 and removable identical upper and lower trays 12. Casters 13 are secured in the lower ends of the frame legs for easy rolling of the cart.

Figure 2:
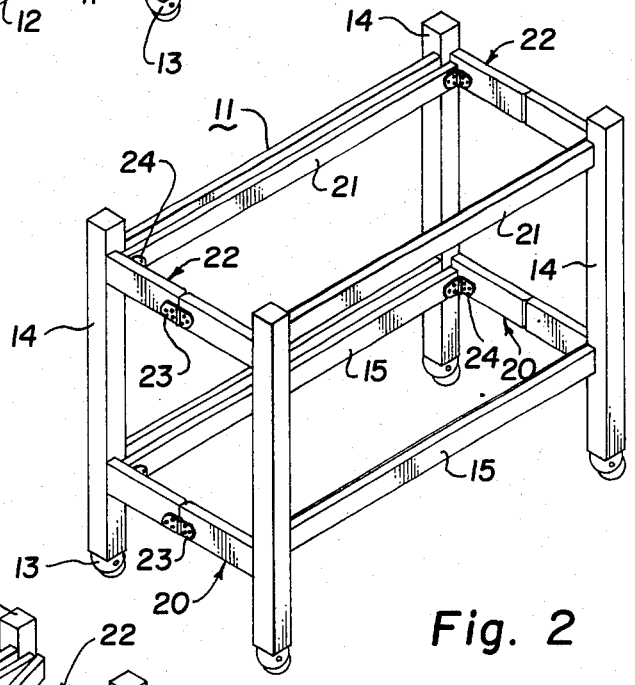
FIG. 2 is a perspective view similar to FIG. 1 showing the tea cart frame with the trays removed.
Figure 5:
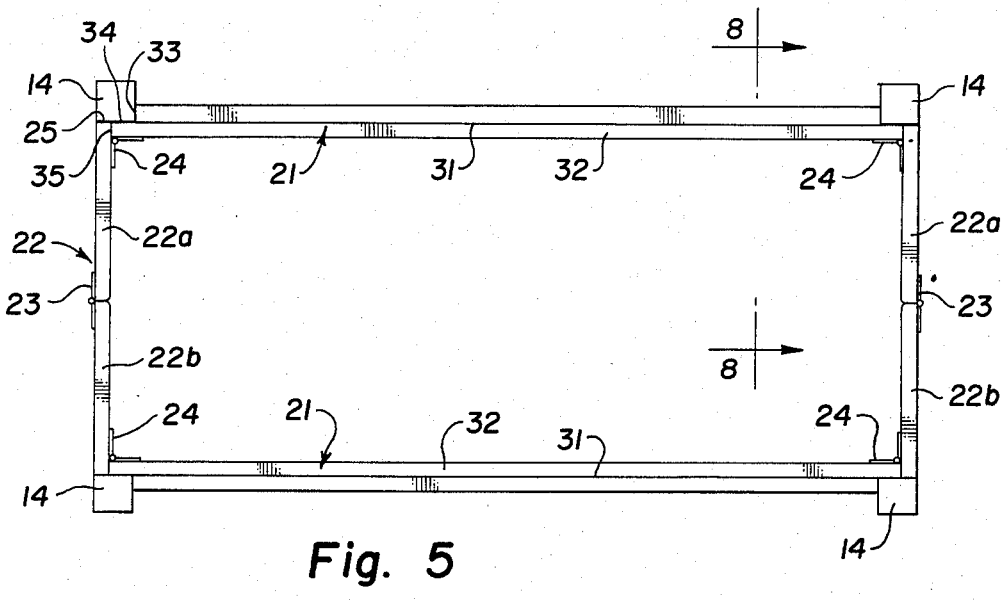
FIG. 5 is a top view of the tea cart frame with the trays removed.
Figure 6:
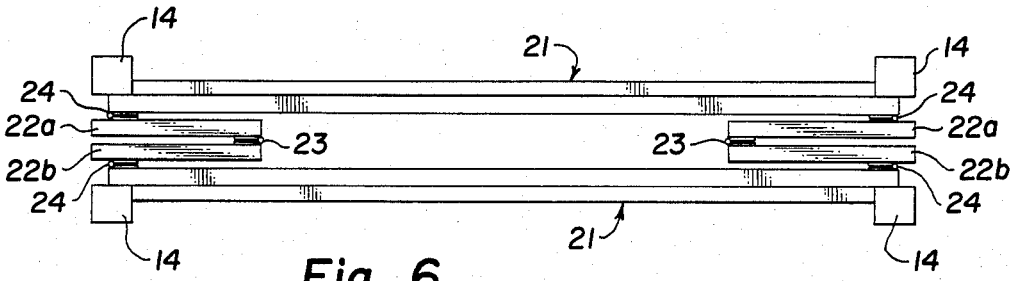
FIG. 6 is a top view of the frame fully folded before the trays are stored in the frame.
Figure 7:
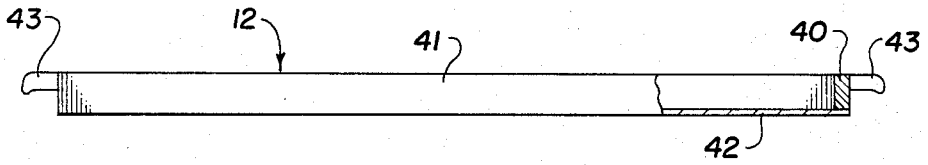
FIG. 7 is a side edge view partially broken away in section of one of the tea cart trays.

The foldable frame 11 includes legs 14, identical lower opposite side rails 15, foldable lower end rail assemblies 20, identical upper opposite side rails 21, and foldable upper end rail assemblies 22. The end rail assemblies 20 and 22 are identical in structure and function and thus only one of the assemblies 22 will be described in detail. Referring particularly to FIGS. 2, 5, and 6, each of the end rail assemblies 22 includes an end rail **22*a* and an end rail 22*b* hinged together along adjacent end portions by a hinge 23 secured along outside end faces of the members 22*a* and 22*b*. One leaf of the hinge 23 is secured to the rail 22*a* while the other leaf of the hinge is secured to the rail 22*b* located on the rail end portions so that when folded outwardly the rails 22*a* and 22*b* are in alignment with each other and adjacent end edges abutting relationship so that together the rails 22*a* and 22*b* form a single horizontal end rail. The adjacent ends of the rails 22*a* and 22*b* fold inwardly as shown in FIG. 6 until the rails are in parallel relationship spaced apart by the combined thickness of the two leaves of the spring 23. Outward opposite end portions of the rails 22*a* and 22*b* are secured by hinges 24 to the inside faces of the upper side rails 21 of the frame. One leaf of one of the hinges 24 is secured with the inside face of the end rail 22*a* while the other leaf of the hinge is secured with the inside face of the adjacent end portion of the side rail 21. The leaf of the hinge secured to the inside face of the rail 22*a* is positioned on the rail face with the hinge pin of the hinge aligned with the plane of the end face of the rail 22*a* and spaced inwardly from such end face substantially the thickness of the adjacent end portion of the rail 21 so that when the end rail assembly 22 is folded outwardly as in FIG. 5, the outward end face 25 of the end rail 22*a* contacts the adjacent inside face of the frame leg 14 providing substantial rigidity to the frame assembly when it is folded outwardly in operating position as seen in FIGS. 1, 2 and 5. At such folded out position of end rail assemblies the adjacent end faces of the rails 22*a* and 22*b* are in contact while the end faces 25 of the rails 22*a* and 22*b* are in contact with the adjacent side faces of the legs 14. It will be evident in FIG. 5 that when the frame is in the folded out operating position the end rails 22*a* and 22*b* are in a straight line relationship perpendicular to the adjacent side rails 21. All of the end rail assemblies 20 and 22 are connected in the same structural relationship with the opposite lower and upper side rails of the frame 11. One lower end rail assembly 20 and one upper end rail assembly 22 are secured in parallel spaced relation between the legs 14 at each end of the frame 11 providing foldable end assemblies for the frame permitting the opposite sides of the frame comprising two legs 14 and lower and upper side rails 15 and 21 to fold together into the parallel collapsed relationship shown in FIGS. 4 and 6**.

Figure 8:
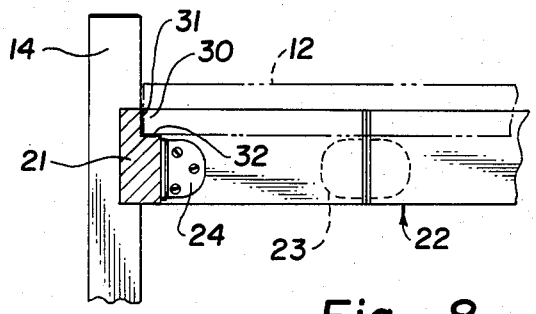
FIG. 8 is an enlarged fragmentary view in section and elevation of the frame taken along the line 8—8 of FIG. 5 showing the upper tray in phantom lines.

The opposite sides of the collapsible frame 11 comprise two legs 14 in spaced parallel relationship rigidly secured together by a lower side rail 15 and an upper side rail 21. The side rails 15 and 21 are identical in structure on each of the sides of the frame. It will be apparent also that the side rails on the opposite sides of the frame are simply mirror images of each other. Thus the structure of only one of the side rails and the connection between only one end portion of one of the side rails and an adjacent leg will be described because all such connections are the same. Referring to FIG. 8 the side rail 21 illustrated has a longitudinal upwardly and inwardly opening recess 30 defined by a longitudinal vertical surface 31 and a longitudinal horizontal surface 32, such surfaces being perpendicular to each other. The recess 30 along the full length of each of the side rails receives the longitudinal lower side portion of one of the trays 12 with the surface 32 providing a supporting flange or shoulder along the full length of the bottom side of the tray. Opposite end portions of each of the side rails is notched providing a vertical recess defined by an end edge surface 33 and an outside vertical surface 34 to receive the adjacent leg 14 of the frame. The longitudinal depth of the leg recess in the side rail is measured by the distance of the end surface 33 from the end surface 35 of the side rail is less than the thickness of the leg 14 by a value equal to the thickness of the end rail assembly members **22*a* and 22*b* so that when the end rail assemblies are folded out as in FIG. 5 the outside face of the rail assembly members lies in the same plane or flush with the adjacent end face of the leg 14**.

Each of the trays 12 comprises a rectangular frame formed by end members 40, side members 41, a bottom 42, and identical end handles 43. The top surfaces of the handles 43 are flush with the top edge surface of the end member 40 to which each handle is secured. The bottom faces of the handles 43 are spaced above the bottom surface of the bottom panel 42 a distance equal to the depth of the recess 30 in the side rails 15 and 21 so that when the trays 12 rest in position in the frame with the bottom surface of the trays engaging the supporting shoulder 32 of the side rails, the bottom surface of the handles 43 will rest on the top edge surfaces of the end rail assembly members to provide end support for the trays. The width of the trays, that is the distance between the outside faces of the side members 41 of the tray frames, is slightly less than the distance between the inside recess surfaces 31 of the upper and lower side rails 15 and 21 so that the trays slip easily into place and are easily removable while being sufficiently snug in position to hold the side rails apart locking the foldable frame 11 in unfolded operating position as shown in FIG. 1. The length of the trays, the distance between the outer surfaces of the end members 40 of the trays is similarly slightly less than the distance between the inside surfaces of the opposite end rail assemblies 22 and 20 when the frame 11 is unfolded in the operating position of FIGS. 1 and 2 so that the trays slide easily into and out of position between the end rail assemblies but fit sufficiently snugly to prevent any inward folding of the end rail assemblies and thus further aid in locking the frame assembly in operating condition.

Figure 4:
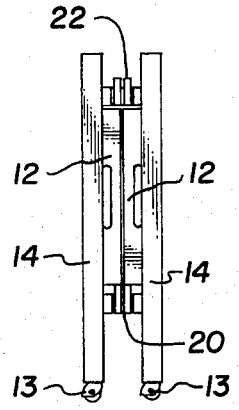
FIG. 4 is an end view of the frame fully folded with the removable trays stored between the frame legs resting on the lower folded end rails and side rails.

Referring to FIGS. 4 and 6, the combined thicknesses of the end rail assembly members, such as **22*a* and 22*b*, the hinge 23, the hinges 24, and the portions of the side rails 15 and 21 inside of the legs 14 is slightly greater than the combined height or thickness of the two trays 12 so that the two trays placed together as shown in FIG. 4 slip easily into the space defined in the folded condition of the frame as in FIG. 6 between the legs 14 above the lower rails 15 and lower folded end rail assemblies 20 below the upper rails 21 and the upper folded end rail assemblies 22** When the trays are so contained within the storage space of the folded frame they will not fall out sidewardly and can be inserted and removed only from either end of the folded frame facilitating handling of the folded frame with the trays stored in the space provided within the frame.

The collapsible table of the invention is used as shown in FIG. 1 with the foldable frame 11 fully folded outwardly from the folded condition of FIG. 6 to the condition of FIG. 2. Starting with the frame fully folded as seen in FIG. 6 it is unfolded by pulling the side rails, such as the rails 21, apart causing the folded end rails to fold outwardly in opposite directions until the end rail assemblies are straight as shown in FIG. 2. In such condition the adjacent end edges of the end rail assemblies are in abutting relationship while the outside end edges 25 on the folding rail assembly members engage the adjacent inside surfaces of the legs 14 to which the ends of the assemblies are hinged providing a rigid rectangular structure as evident in FIG. 5. The trays 12 are then placed into the upper and lower rectangular frames defined by the side rails 21 and end rail assemblies 22 and side rails 15 and end rail assemblies 20, respectively. The trays are stabley supported by the end handles 43 resting on the top edges of the end rail assemblies and the longitudinal bottom side edge portions of the bottoms 42 of the trays resting on the shoulder surfaces 32 along the recesses 30 of the side rails. The trays are thus stabley supported and lock the side rails apart and the folding end rail assemblies against folding.

Figure 3:
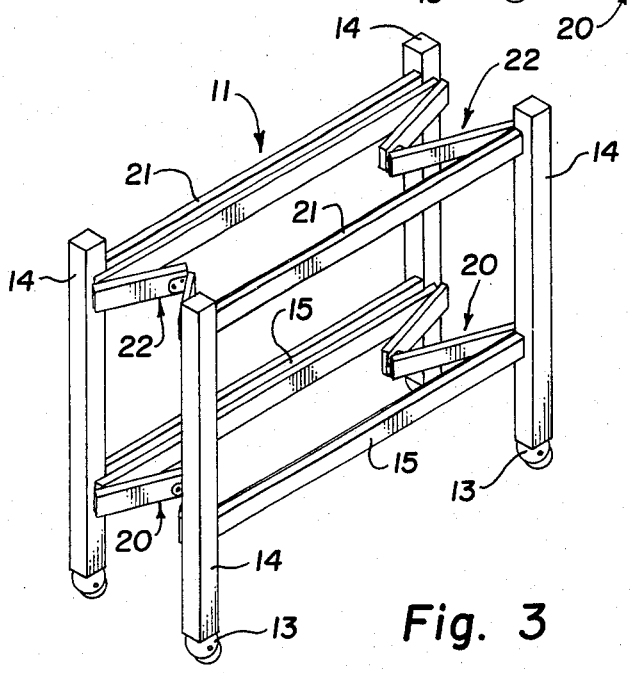
FIG. 3 is a perspective view of the frame of FIG. 2 partially folded.

When folding of the table 10 is desired, the two trays 12 are lifted and removed from the foldable frame 11. The end rail assemblies 20 at the lower level and 22 at the upper level are pressed inwardly toward each other by gentle pressure at the hinges 23 of the assemblies folding the end rail assemblies inwardly as shown in FIG. 3 as the side rails are urged together until the frame is fully folded as represented in FIGS. 4 and 6. The trays 12 are then placed together with the bottoms 42 of the trays touching each other and the two trays in such parallel relationship are inserted into the folded frame from either end into the storage space between the legs and the upper and lower rails supported on the folded bottom rail assemblies 20. Thus a very stable mobile table is provided which provides for efficient tray storage and easy handling of both the frame and trays when fully collapsed or folded.

What is claimed is:

1. A foldable table comprising: a pair of oppositely disposed rigid side frame members each having an upwardly and inwardly opening longitudinal recess providing a tray edge support surface; foldable end assemblies connected between said side members for operation between a first folded condition wherein said side members are in close spaced substantially parallel relation with said end assemblies folded therebetween and a second extended condition wherein said side members are in farther apart spaced substantially parallel extended condition; and tray means engageable between said side members on said supporting surfaces of said side members and between said end assemblies when said end assemblies are in said extended condition, said tray means locking said side members in said extended condition and holding said end assemblies against folding.

2. A foldable table in accordance with claim 1 wherein said end assemblies comprise two end rail members hinged together at adjacent ends and hinged at opposite ends with said side frame members and said tray means end edges fit within inside faces of said end rail members when said end assemblies are in said extended condition.

3. A foldable table in accordance with claim 2 wherein said side frame members comprise side rail means having said tray supporting surface thereon and two legs secured in spaced relation to opposite ends of said side rail means.

4. A portable table in accordance with claim 3 wherein said side rail means comprises an upper side rail and a lower side rail and said tray means comprises an upper tray and a lower tray.

5. A foldable table in accordance with claim 4 wherein said trays are longer than the distance between said frame legs and said side frame members are in substantially parallel spaced relation on opposite sides of said end assemblies when said end assemblies are folded whereby said end assemblies, said legs, and said upper and lower side rails define storage space for said trays when said side frame members and said end assemblies are in folded condition.

6. A foldable table in accordance with claim 5 including casters on each of said frame legs whereby said table may roll on a supporting floor surface.

7. A foldable table in accordance with claim 5 wherein said side rails include said tray supporting surfaces along the full length of each of said rails for engagement with longitudinal bottom side edge portions of said trays.

8. A foldable table in accordance with claim 7 wherein said trays each includes end handles having support surface portions engageable with supporting surfaces on said foldable end assemblies when said trays are inserted between said side frame members and said extended end assemblies.

9. A foldable table in accordance with claim 8 wherein said trays are rectangular and said side frame members and said foldable end assemblies define rectangular openings for said trays when in extended condition, a close fitting relation between said openings and said trays permitting easy insertion and removal of said trays and permitt1ng said trays to hold said side frame members and said foldable end assemblies locked in extended operating condition when said trays are inserted within said openings.

10. A foldable table comprising: opposite side frame assemblies having spaced parallel end legs and spaced parallel upper and lower side rails connected at opposite ends with said legs, said side rails each having a longitudinal upwardly and inwardly opening recess defining an upwardly facing tray support surface the full length of each of said side rails; a pair of upper and a pair of lower foldable end rail assemblies each comprising two end rail members hinged together at adjacent ends and opposite end portions of said end rail members being hinged with inside surfaces of said side rails, said upper end rail assemblies being connected between said side frame assemblies in horizontal alignment with said upper side rails and said lower end rail assemblies being connected between said side frame assemblies in horizontal alignment with said lower side rails, said end rail assemblies being extendable into straight line relationship for holding said side frame assemblies in substantially parallel spaced apart extended relation and being foldable together between said side rail assemblies in close folded relation; and rectangular upper and lower trays insertable between said upper side rails and said lower side rails between said end assemblies when said assemblies are in extended condition, said trays resting on said side rails supporting surfaces and engaging said extended end rail assemblies locking said side frame and said end rail assemblies in extended operating condition.

11. A foldable table in accordance with claim 10 wherein said tray support surfaces along said side rails extend in overlapping relationship within said legs, said end rail members of said end rail assemblies have adjacent end surfaces which abut and engage when said assemblies are in said extended straight line relationship, and said end rails have opposite end surfaces which engage inside leg surfaces endwardly of said side rails whereby said side frame assemblies and said foldable end assemblies are stabilized in extended condition.

12. A foldable table in accordance with claim 11 wherein each of said trays has opposite end handles having bottom surfaces engageable with top surfaces on said end rail assemblies for supporting said ends of said trays when installed between said frame assemblies.

* * * * *